United States Patent [19]

Burton

[11] 4,049,470

[45] Sept. 20, 1977

[54] REFINING NICKEL BASE SUPERALLOYS

[75] Inventor: Claudia J. Burton, Clinton, N.Y.

[73] Assignee: Special Metals Corporation, New Hartford, N.Y.

[21] Appl. No.: 681,297

[22] Filed: Apr. 29, 1976

[51] Int. Cl.[2] ..... C22F 1/10

[52] U.S. Cl. ..... 148/3; 75/10 V; 75/82; 75/170; 75/171

[58] Field of Search ..... 148/2, 3; 75/170, 171, 75/82, 10 V

[56] References Cited

U.S. PATENT DOCUMENTS

| | | | |
|---|---|---|---|
| 3,853,540 | 12/1974 | Schlatter et al. | 75/82 |
| 3,891,425 | 6/1975 | McCarty | 75/10 V |

*Primary Examiner*—R. Dean

*Attorney, Agent, or Firm*—Vincent G. Gioia; Robert F. Dropkin

[57] ABSTRACT

A process for producing a low iron nickel base superalloy having a very low selenium content. The process includes the steps of: preparing a superalloy melt containing, by weight, at least 60% nickel, no more than 1% iron, and more than 0.0004% selenium; maintaining the melt in contact with a calcium and/or magnesium bearing substance for a period of time sufficient to allow for reaction between selenium and calcium and/or magnesium, and a lowering of said melt's selenium content to a level below 0.0003%, said selenium removal being carried out in a substantially oxygen free atmosphere; casting the melt; and heat treating the cast metal.

6 Claims, No Drawings

REFINING NICKEL BASE SUPERALLOYS

The present invention relates to a process for removing selenium from a low iron, nickel base superalloy.

Selenium concentrations greater than 3 ppm (parts per million) are known to be detrimental to nickel base superalloys. Metallic selenides segregate at grain boundaries, thereby embrittleing the alloy and causing a deterioration of its stress-rupture properties.

To make superalloys with selenium levels below 3 ppm, manufacturers have had to carefully select their raw materials. For example, they have had to use carbonyl nickel rather than electrolytic nickel, as carbonyl nickel contains considerably less selenium than does electrolytic nickel. Investigations have shown that there is very little evaporation of selenium from vacuum induction melts.

Through the present invention there is now provided a process for lowering the selenium content of a low iron, nickel base superalloy to a level below 3 ppm. Basically, the method involves the step of maintaining the melt in contact with calcium and/or magnesium bearing substances for a period of time sufficient to allow for reaction between said calcium and/or magnesium, and selenium. Prior to the present invention, somewhat similar processing has been used to lower the sulfur content of nickel base superalloys (see U.S. Pat. Nos. 3,853,540 and 3,891,425), and particularly high iron, nickel base superalloys. To the best of my knowledge, such processing has not been applied to low iron, nickel base superalloys having in excess of 4 ppm selenium.

It is accordingly an object of the present invention to provide a process for removing selenium from a low iron, nickel base superalloy.

It is a further object of the present invention to provide a process for producing a low iron, nickel base superalloy having a trace element specification for selenium; which allows for the utilization of electrolytic nickel.

In accordance with the present invention, a selenium bearing, low iron, nickel base superalloy is subjected to the conventional steps of casting and heat treating; and to the improvement, of maintaining the melt in contact with a calcium and/or magnesium bearing substance for a period of time sufficient to allow for reaction between selenium, and calcium and/or magnesium, and a lowering of the melt's selenium content to a level below 0.0003%, and preferably below 0.0002%. By selenium bearing, low iron, nickel base superalloys, the subject invention is specifically referring to alloys having at least 60% nickel, no more than 1% iron, and more than 0.0004% selenium. Also includeable within said alloys are all those elements which contribute to the outstanding properties of superalloys. As for the selenium removal, it must be conducted in a substantially oxygen free atmosphere. Calcium and magnesium bearing substances can be melted with the base charge or added later on in the processing. Calcium bearing substances are preferred. Typical calcium bearing substances are CaO and CaNi. Since a slag accumulates on the melt surface during the selenium removal, it is desirable to pour the molten metal through a refractory filtering system to reduce the possibility of inclusions, which contaminate the metal.

The following example is illustrative of several aspects of the invention.

A nickel base superalloy having the chemistry listed hereinbelow in Table I was remelted in a vacuum induction furnace.

TABLE I.

| COMPOSITION (WT. %) | | | | | | | | | | | |
|---|---|---|---|---|---|---|---|---|---|---|---|
| C | Cr | Co | Mo | Ti | Al | B | Ta | Hf | S | Se | Ni* |
| 0.11 | 8.2 | 10.1 | 6.0 | 0.98 | 5.90 | 0.014 | 4.21 | 1.15 | 0.001 | ~0.0005 | Bal. |

*electrolytic nickel

As the selenium content of the alloy was approximately 5 ppm, the melt was treated with 0.5% additions of CaO and CaNi. Pressure in the chamber was less than one micron throughout the melt cycle. The heat was subsequently poured under a 5 mm argon atmosphere. Subsequent chemical analysis using mass spectrographic techniques indicated a reduction in selenium to a level of approximately 0.5 ppm.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing a low iron, nickel base superalloy, which process includes the steps of preparing a superalloy melt containing, by weight, at least 60% nickel, no more than 1% iron, and more than 0.0004% selenium; casting said melt; and heat treating the cast metal; the improvement comprising the steps of maintaining said melt in contact with a calcium and/or magnesium bearing substance for a period of time sufficient to allow for reaction between selenium, and calcium and/or magnesium, and a lowering of said melt's selenium content to a level below 0.0003%, said selenium removal being carried out in a substantially oxygen free atmosphere, said reacted selenium accumulating as slag on the surface of said melt, said selenium-bearing slag being separated from said melt prior to solidification of said melt.

2. An improvement according to claim 1, including the step of filtering said melt to reduce the possibility of contaminating said resultant superalloy.

3. An improvement according to claim 1, wherein said melt is maintained in contact with said calcium and/or magnesium bearing substance for a period of time sufficient to lower said melts selenium content to a level below 0.0002%.

4. An improvement according to claim 1, wherein said melt is maintained in contact with a calcium bearing substance.

5. An improvement according to claim 4, wherein said calcium bearing substance is from the group consisting of CaO and CaNi.

6. An improvement according to claim 1, wherein said nickel in said melt is electrolytic nickel.

* * * * *